US008618443B2

(12) United States Patent
Inoue et al.

(10) Patent No.: US 8,618,443 B2
(45) Date of Patent: Dec. 31, 2013

(54) VEHICLE LIGHTING DEVICE

(75) Inventors: Kotoka Inoue, Tokyo (JP); Katsuhiro Murahashi, Tokyo (JP); Hiroto Tokunaga, Tokyo (JP)

(73) Assignee: Ichikoh Industries, Ltd., Tokyo (JP)

( * ) Notice: Subject to any disclaimer, the term of this patent is extended or adjusted under 35 U.S.C. 154(b) by 929 days.

(21) Appl. No.: 12/500,759

(22) Filed: Jul. 10, 2009

(65) Prior Publication Data

US 2010/0006554 A1 Jan. 14, 2010

(30) Foreign Application Priority Data

Jul. 14, 2008 (JP) ..... 2008-183152

(51) Int. Cl.
*F25D 27/00* (2006.01)

(52) U.S. Cl.
USPC ..... 219/202; 362/92

(58) Field of Classification Search
USPC ..... 219/201–203, 209, 214, 219, 220, 254; 296/95.1; 244/134; 439/36, 151, 226, 439/242, 251
See application file for complete search history.

(56) References Cited

U.S. PATENT DOCUMENTS 2,502,291 A * 3/1950 Taylor ..... 29/830
3,371,249 A * 2/1968 Prohofsky ..... 361/792
4,787,853 A * 11/1988 Igarashi ..... 439/55

FOREIGN PATENT DOCUMENTS

JP 2008052919 A * 3/2008

* cited by examiner

*Primary Examiner* — Henry Yuen
*Assistant Examiner* — Thomas Ward
(74) *Attorney, Agent, or Firm* — Foley & Lardner LLP

(57) ABSTRACT

A conventional vehicle lighting device has entailed a problem on swaging and fixing a power-feeding portion and a connector to each other insofar. In the present invention, a connector is made up of: a male terminal set at a power-feeding electrically conductive paste on one face of a power-feeding film of a power-feeding portion; a grommeted terminal board (primary swaging tool) on which the terminal and the power-feeding portion have been swaged; and a resin board (secondary swaging tool) on which the male terminal, the power-feeding portion, and the grommeted terminal board have been swaged. As a result, in the present invention, a swaging fixing strength between the power-feeding portion and the connector can be improved by means of the primary swaging fixing of the grommeted terminal board and the secondary swaging fixing of the resin board.

3 Claims, 12 Drawing Sheets

VEHICLE LIGHTING DEVICE

CROSS-REFERENCE TO RELATED APPLICATIONS

This application claims priority of Japanese Patent Application No. 2008-183152 filed on Jul. 14, 2008. The contents of this application are incorporated herein by reference in their entirety.

BACKGROUND OF THE INVENTION

The present invention relates to a vehicle lighting device in which a lamp lens forms a snow-melting (ice-melting, cloud-proof) structure.

Conventionally, the vehicle lighting device of this type has been known (Japanese Laid-open Patent Application No. 2008-52919, for example). Hereinafter, the conventional vehicle lighting device will be described. The conventional vehicle lighting device is provided with: a lamp lens; a wire heater provided by being transferred to the lamp lens; and a power-feeding portion for feeding a power current to the wire heater.

Hereinafter, an effect of the conventional vehicle lighting device will be described. When a power current is fed from the power-feeding portion to the wire heater, the wire heater is heated, and snow, ice, or cloud adhering to the lamp lens is then melted or removed due to a heat from the heater. As a result, a loss of light illuminated from the lamp lens to the outside can be prevented. In particular, this is effective in a vehicle lighting device using a light source which is low at a temperature of light illuminated from the lamp lens in comparison with a halogen bulb or an incandescent bulb, for example, a semiconductor-type light source such as a LED or an electric discharge lamp such as a HID.

The problem to be solved by the invention is to improve the conventional vehicle lighting device described previously.

SUMMARY OF THE INVENTION

A first aspect of the invention is directed to a vehicle lighting device, comprising: (i) a lamp housing, which partitions a lamp room, and a lamp lens; (ii) a light illuminating portion which is disposed in the lamp room and externally illuminates through the lamp lens; (iii) a wire heater provided by means of transfer at a portion of the lamp lens through which light from the light illuminating portion is permeated; (iv) a power-feeding portion which is integrally provided at the wire heater, for feeding a power current to the wire heater; and (v) a connector which is provided at the power-feeding portion and is electrically connected to a power source-side connector, wherein the wire heater is a transfer-type wire heater including: (a) a base film; (b) an adhesive provided on one face of the base film; (c) an electrically conductive member for heater which is formed in a wire pattern on the other face of the base film, a power current being fed, thereby generating a heat; and (d) a resist provided on the other face of the base film so as to cover the electrically conductive member for heater, at least the base film being cut in a pattern that follows the wire pattern of the electrically conductive member for heater and which is caused to adhere the adhesive to the lamp lens, thereby transferring the electrically conductive member for heater to the lamp lens, the power-feeding portion including: (a) a power-feeding film integrally provided on the base film; and (b) a power-feeding electrically conductive member which is formed in a wire pattern on one face of the power-feeding film, one end of which is electrically connected to the electrically conductive member for heater; the connector including: (a) a terminal which is set at the power-feeding electrically conductive member on one face of the power-feeding film; and (b) a swaging portion for swaging the terminal and the power-feeding portion.

A second aspect of the present invention is directed to the vehicle lighting device according to the first aspect, wherein: the swaging portion of the connector is a second swaging portion; the connector includes a first swaging portion for swaging and fixing the terminal and the power-feeding portion to each other in advance in a multilayered state before the second swaging portion swages the terminal and the power-feeding portion; and the second swaging portion is for swaging and fixing the terminal, the power-feeding portion, and the first swaging portion to each other, in a state in which the first swaging portion has swaged the terminal, the power-feeding portion, and a grommeted terminal board to each other.

A third aspect of the present invention is directed to the vehicle lighting device according to the first aspect, wherein: an extension portion of a predetermined length is provided between the wire heater and the power-feeding portion; and the extension portion includes: an extension film integrally provided by a predetermined length between the base film and the power-feeding film; and an electrically conductive member for extension formed in a wire pattern on one face of the extension film, both ends of which are electrically connected to the electrically conductive member for heater and the power-feeding electrically conductive member, respectively.

A fourth aspect of the present invention is directed to a vehicle lighting device, comprising: (i) a lamp lens; (ii) a wire heater which is transferred to an interior face of the lamp lens and is capable of generating a heat according to feeding of a power current; (iii) a power-feeding portion which is connected to the wire heater, for feeding the power current to the wire heater; (iv) a terminal which is electrically connected to the power-feeding portion, for feeding a power current from a power source to the power-feeding portion; and (v) a connector having a swaging portion, for electrically connecting the terminal and the power-feeding portion to each other, the connector including: (a) a first swaging portion for swaging and fixing the terminal and the power-feeding portion to each other in a multilayered state; and (b) a second swaging portion for swaging and fixing the terminal, the power-feeding portion, and the first swaging portion to each other, in a state in which the first swaging portion has swaged and fixed the terminal and the power-feeding portion to each other.

A fifth aspect of the present invention is directed to the vehicle lighting device according to the fourth aspect, wherein: a hole is formed at a respective one of the terminal and the power-feeding portion; the first swaging portion has a hollowed protrusion to be inserted into the hole of the respective one of the terminal and the power-feeding portion in the multilayered state, the protrusion being inserted into the hole of the respective one of the terminal and the power-feeding portion, thereby swaging and fixing the terminal and the power-feeding portion to each other in the multilayered state; and the second swaging portion has a swaging protrusion to be inserted into the hollow of the protrusion of the first swaging portion, the swaging protrusion being inserted into the protrusion of the first swaging portion, in a state in which the terminal and the power-feeding portion are swaged and fixed to each other, thereby swaging and fixing the terminal, the power-feeding portion, and the first swaging portion to each other.

A sixth aspect of the present invention is directed to the vehicle lighting device according to the fourth aspect, wherein: the connector further includes an insulation sealing portion covering a surface portion on which the respective one of the first swaging portion and the second swaging portion has been swaged, in a state in which the second swaging portion has swaged and fixed the terminal, the power-feeding portion, and the first swaging portion to each other.

A seventh aspect of the present invention is directed to the vehicle lighting device according to the fourth aspect, wherein: protrusive ribs are provided at four edges of one face of the second swaging portion; the connector further includes an insulation sealing portion covering a surface portion on which the respective one of the first swaging portion and the second swaging portion has been swaged, the surface portion being surrounded by the ribs of the second swaging portion, in a state in which the second swaging portion has swaged and fixed the terminal, the power-feeding portion, and the first swaging portion to each other.

An eighth aspect of the present invention is directed to the vehicle lighting device according to the fourth aspect, comprising: an extension portion which is extended from the wire heater by a predetermined length and is arranged on an interior face of the lamp lens, the extension portion electrically connecting the wire heater and the power-feeding portion to each other and feeding the power current from the power-feeding portion to the wire heater side, wherein one end of the extension portion is fixed to a front face in the lamp lens, together with the wire heater to which the one end thereof is connected; and the other end of the extension portion is fixed to a side wall erected laterally of the lamp lens, by means of the first swaging portion and the second swaging portion, together with the power-feeding portion to which the other end of the extension portion is connected.

A ninth aspect of the present invention is directed to the vehicle lighting device according to the eighth aspect, wherein: the extension portion includes: an adhesive part which is disposed on a face opposite to the interior face of the lamp lens, is arranged at a side of the wire heater, and adheres to the interior face of the lamp lens; and a non-adhesive part which is disposed on a face opposite to the interior face of the lamp lens, is arranged at a side of the power-feeding portion, and is formed in an rough shape by means of an optically permeable letterpress-printed film pattern so as to prevent a portion other than the adhesive part from adhering to the interior face of the lamp lens.

A tenth aspect of the present invention is directed to the vehicle lighting device according to the eighth aspect, wherein: the wire heater includes: an adhesive part adhering to the interior face of the lamp lens; a resin film portion which is multilayered on the adhesive part; an electrically conductive paste portion which is multilayered on the resin film portion, is formed in a predetermined wire pattern, and generates a heat due to an electrical resistance in accordance with the feeding of the power current; and an insulation resist portion which is multilayered on the electrically conductive paste portion, for surface-protecting the electrically conductive paste portion, the extension portion includes: a resin film portion which is extended from the resin film portion of the wire heater; and an electrically conductive paste portion which is extended from the electrically conductive film portion of the wire heater, the power-feeding portion includes: a resin film portion which is extended from the resin film portion of the extension portion; and an electrically conductive paste portion which is extended from the electrically conductive paste portion of the extension portion, the resin film portion of the extension portion is manufactured in a process which is identical to that of manufacturing the resin film of the respective one of the wire heater and the power-feeding portion, and the electrically conductive paste portion of the extension portion is manufactured in a process which is identical to that of manufacturing the electrically conductive paste portion of the respective one of the wire heater and the power-feeding portion.

An eleventh aspect of the present invention is directed to the vehicle lighting device according to the tenth aspect, wherein: the first swaging portion is for swaging and fixing the electrically conductive paste portion and the terminal, of the power-feeding portion; and the second swaging portion is for swaging and fixing the electrically conductive paste portion, the terminal, and the first swaging portion, of the power-feeding portion, to each other, in a state in which the first swaging portion has swaged and fixed the electrically conductive paste portion and the terminal of the power-feeding portion to each other.

A twelfth aspect of the present invention is directed to a vehicle lighting device, comprising: (i) a lamp lens; (ii) a wire heater which is transferred to an interior face of the lamp lens and is capable of generating a heat in accordance with feeding of a power current; (iii) a power-feeding portion which is connected to the wire heater, for feeding the power current to the wire heater; (iv) a terminal which is electrically connected to the power-feeding portion, for feeding a power current from a power source to the power-feeding portion; and (v) a connector for electrically connecting the terminal and the power-feeding portion to each other, wherein the connector includes a swaging portion which is fixed to a side wall interior face of the lamp lens together with the power-feeding portion, for swaging and fixing the terminal and the power-feeding portion in a multilayered state.

A thirteenth aspect of the present invention is directed to the vehicle lighting device according to the twelfth aspect, wherein: a hole is formed at a respective one of the terminal and the power-feeding portion; and the swaging portion has a swaging protrusion which is inserted into the hole of the respective one of the terminal and the power-feeding portion in the multilayered state, the swaging protrusion being inserted into the hole of the respective one of the terminal and the power-feeding portion, thereby swaging and fixing the terminal and the power-feeding portion in the multilayered state.

A fourteenth aspect of the present invention is directed to the vehicle lighting device according to the twelfth aspect, wherein: the connector further includes an insulation sealing portion covering a swaged surface portion of the swaging portion in a state in which the swaging portion has swaged and fixed the terminal and the power-feeding portion to each other.

A fifteenth aspect of the present invention is directed to the vehicle lighting device according to the twelfth aspect, wherein: the swaging portion of the connector is a second swaging portion; and the connector further includes a first swaging portion for swaging and fixing the terminal and the power-feeding portion in advance in a multilayered state before the second swaging portion swages and fixes the terminal and the power-feeding portion to each other.

A sixteenth aspect of the present invention is directed to the vehicle lighting device according to the fifteenth aspect, wherein: a hole is formed at a respective one of the terminal and the power-feeding portion; the first swaging portion has a hollowed protrusion inserted into the hole of the respective one of the terminal and the power-feeding portion in the multilayered state, the protrusion being inserted into the hole of the respective one of the terminal and the power-feeding portion, thereby swaging and fixing the terminal and the power-feeding portion in the multilayered state; and the second swaging has a swaging protrusion which is inserted into a hollow of the protrusion of the first swaging portion, in a state in which the first swaging portion has swaged and fixed the terminal and the power-feeding portion to each other, the swaging protrusion being inserted into the protrusion of the first swaging portion, thereby swaging and fixing the terminal, the power-feeding portion, and the first swaging portion to each other.

A seventeenth aspect of the present invention is directed to the vehicle lighting device according to the twelfth aspect, further comprising: an extension portion which is extended from the wire heater by a predetermined length, arranged on an interior face of the lamp lens, and electrically connects the wire heater and the power-feeding portion to each other in order to feed the power current from the power-feeding portion to a side of the wire heater, wherein one end of the extension portion is fixed to a front face in the lamp lens, together with the wire heater to which the one end thereof is connected; and the other end of the extension portion is fixed to a side wall erected laterally inside of the lamp lens by means of the swaging portion, together with the power-feeding portion to which the other end of the extension portion is connected.

An eighteenth aspect of the present invention is directed to the vehicle lighting device according to the seventeenth aspect, wherein: the extension portion includes: an adhesive part which is disposed on a face opposite to the interior face of the lamp lens, is arranged at a side of the wire heater, and adheres to the interior face of the lamp lens; and a non-adhesive part which is disposed on the face opposite to the interior face of the lamp lens, is arranged at a side of the power-feeding portion, and is formed in an rough shape by means of a optically permeable letterpress-printed film pattern so as to prevent a portion other than the adhesive part from adhering to the interior face of the lamp lens.

A nineteenth aspect of the present invention is directed to the vehicle lighting device according to the seventeenth aspect, wherein: the wire heater includes: an adhesive part adhering to the interior face of the lamp lens; a resin film portion multilayered on the adhesive part; an electrically conductive paste portion which is multilayered on the resin film portion, and is formed in a predetermined wire pattern, for generating a heat due to an electrical resistance in accordance with the feeding of the power current; and an insulation resist portion which is multilayered on the electrically conductive paste portion, for surface-protecting the electrically conductive paste portion, the extension portion includes: a resin film portion which is extended from the resin film portion of the wire heater; and an electrically conductive paste portion which is extended from the electrically conductive film portion of the wire heater, the power-feeding portion includes: a resin film portion which is extended from the resin film portion of the extension portion; and an electrically conductive paste portion which is extended from the electrically conductive paste portion which is extended from the electrically conductive paste portion of the extension portion, the resin film portion of the extension portion is manufactured in a process which is identical to that of manufacturing the resin film of the respective one of the wire heater and the power-feeding portion, and the electrically conductive paste portion of the extension portion is manufactured in a process which is identical to that of manufacturing the electrically conductive paste portion of the respective one of the wire heater and the power-feeding portion.

A twentieth aspect of the present invention is directed to the vehicle lighting device according to the nineteenth aspect, wherein: the swaging portion is for swaging and fixing the electrically conductive paste portion of the power-feeding portion and the terminal in the multilayered state.

In a vehicle lighting device of the present invention, a connector is formed by fixing a terminal and a power-feeding portion by means of the primary swaging of a grommeted terminal board, and further, fixing the terminal, the power-feeding portion, and the grommeted terminal board by means of the secondary swaging of the resin board. Therefore, in the vehicle lighting device of the present invention, a swaging fixing strength between the power-feeding portion and the connector can be improved by the primary swaging fixing of the grommeted terminal board and the secondary swaging fixing of a resin board, in comparison with a connector formed by fixing a terminal and a power-feeding portion by swaging a grommeted terminal board (swaging tool) or a connector formed by fixing a resin base, a terminal, and a power-feeding portion by swaging a grommeted terminal board (swaging tool).

In the vehicle lighting device of the present invention, a connector is formed by fixing a terminal and a power-feeding portion to each other by swaging a resin board (swaging tool), and therefore, a swaging fixing strength between the power-feeding portion and the connector can be improved in comparison with a connector formed by fixing a terminal and a power-feeding portion by swaging a metallic grommeted terminal board (swaging tool). Moreover, the vehicle lighting device of the present invention is formed by fixing the terminal and the power-feeding portion to each other by swaging the resin board (swaging tool), and therefore, the number of parts can be reduced and manufacturing cost can be reduced accordingly, in comparison with a connector formed by fixing a resin base, a terminal, and a power-feeding portion to each other by swaging a grommeted terminal board (swaging tool).

Further, in the vehicle lighting device of the present invention, an extension portion made up of an extension film and an electrically conductive member for extension is provided between a wire heater and a power-feeding portion, thus eliminating a harness. As a result, the vehicle lighting device of the present invention can reduce manufacturing cost in comparison with the vehicle lighting device in which a power-feeding portion is made of a harness. Further, there is no problem on durability such as release of a wire heater transferred to a lamp lens due to a weight of a harness, an excessive load on the wire heater, or damaging the lamp lens by the harness.

Furthermore, in the vehicle lighting device of the present invention, by means of an extension portion provided between a wire heater and a power-feeding portion, the wire heater and the power-feeding portion can be provided, respectively, at other separate positions of a lamp lens while an electrical connection is maintained. As a result, in the vehicle lighting device of the present invention, the wire heater can be provided at a portion illuminated with light, of the lamp lens, and the power-feeding portion can be provided at an inconspicuous portion of the lamp lens (i.e., a portion which is free of light illumination and which is not required to provide a wire heater, such as a side wall or an erected wall mounted to a lamp housing, for example). In this manner, in the vehicle lighting device of the present invention, there is no need to provide the power-feeding portion to a conspicuous portion of the lamp lens, thus making it possible to solve problems such as impairment on appearance or impairment on design. In addition, there is no need to provide the wire heater at a position reaching up to an inconspicuous portion of the lamp lens, making it possible to solve problems on manufacturing cost or power consumption.

Moreover, in the vehicle lighting device of the present invention, by means of an extension portion provided between a wire heater and a power-feeding portion, the wire heater and the power-feeding portion can be fixed, respectively, at positions distant from each other of a lamp lens, thus allowing the wire heater to be reliably and easily transferred to the lamp lens. In other words, it is difficult to adjacently transfer the wire heater and the power-feeding portion having a width larger than that of the wire heater to the lamp lens. However, in the vehicle lighting device of the present invention, there is no need to fix the wire heater and the power-feeding portion having the width larger than that of the wire heater to the lamp lens, thus allowing the wire heater to be reliably and easily transferred to the lamp lens.

DESCRIPTION OF THE PREFERRED EMBODIMENTS

Figure 1:
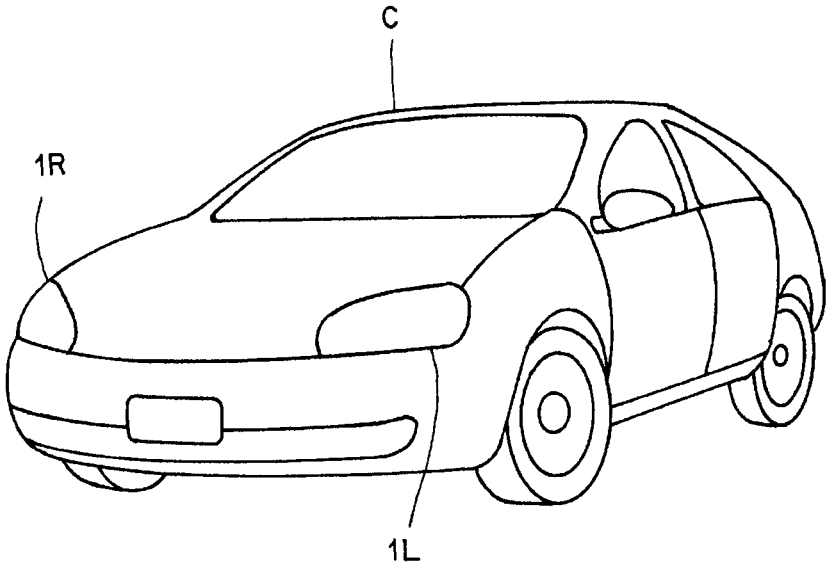
FIG. 1 is an explanatory view showing a first embodiment of a vehicle lighting device according to the present invention and a state in which the lighting device is used for a vehicle head lamp.

Hereinafter, two of the embodiments of the vehicle lighting device according to the present invention will be described in detail, referring to the drawings. These embodiments do not limit the present invention.

First Embodiment

FIGS. 1 to 16 show the first embodiment of the vehicle lighting device according to the present invention. Hereinafter, a constitution of the vehicle lighting device according to the first embodiment will be described. The vehicle lighting device according to the first embodiment includes head lamps 1L, 1R for vehicles, illuminating a predetermined light distribution pattern, for example, a light distribution pattern for passing. The head lamps 1L, 1R are equipped at both left and right sides of a front part of a vehicle C, respectively, as shown in FIG. 1. Hereinafter, the left-side head lamp 1L will be described. A structure of the right-side head lamp 1R is substantially reversed at the left and right sides from that of the left-side head lamp 1L.

Figure 2:
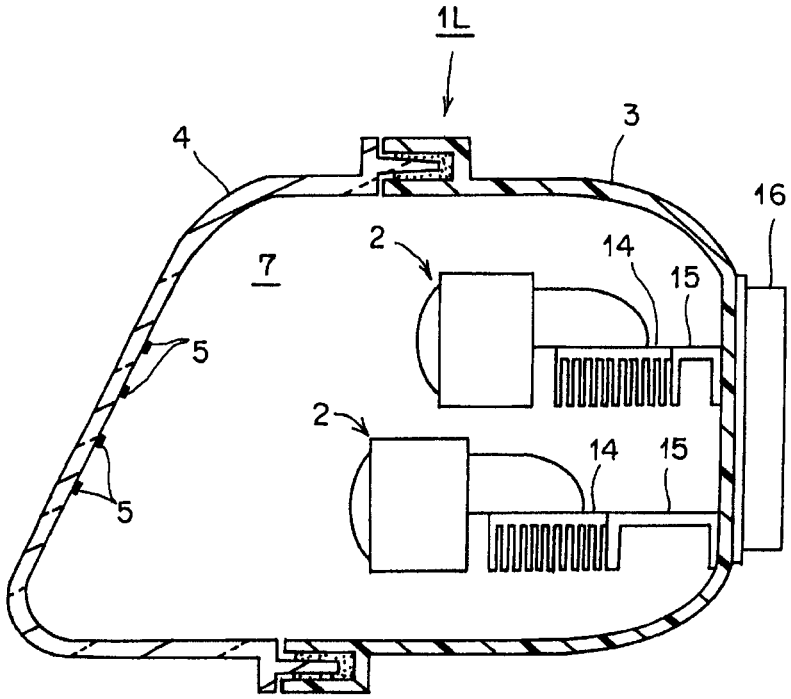
FIG. 2 is a vertical cross sectional view (longitudinal cross sectional view) of the head lamp, similarly.
Figure 4:
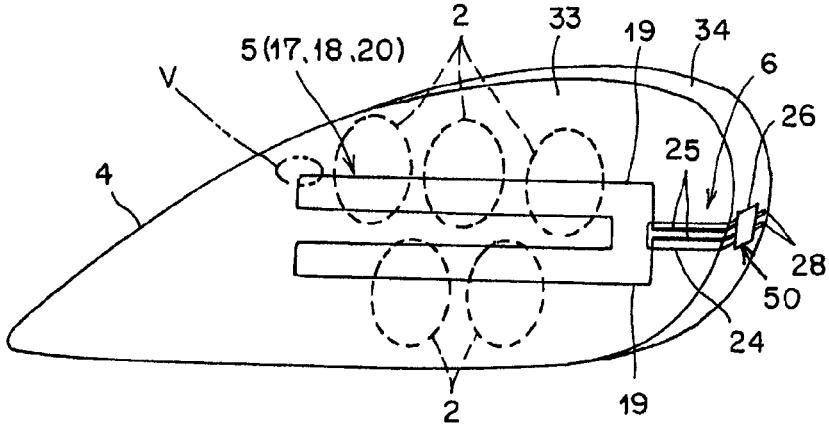
FIG. 4 is a perspective view of a lamp lens used in the head lamp, similarly.

The head lamp 1L, as shown in FIGS. 2 and 4, is provided with: five lamp units 2; a lamp housing 3; a lamp lens 4; a wire heater 5; an extension portion 6; a power-feeding portion 50; and a connector 26. A lamp room 7 is partitioned by the lamp housing 3 and the lamp lens 4. In the lamp room 7, the five lamp units 2 are disposed at the upper and lower stages, separately (three of them are disposed at the upper stage and the remaining two of them at the lower stage in the embodiment).

Figure 3:
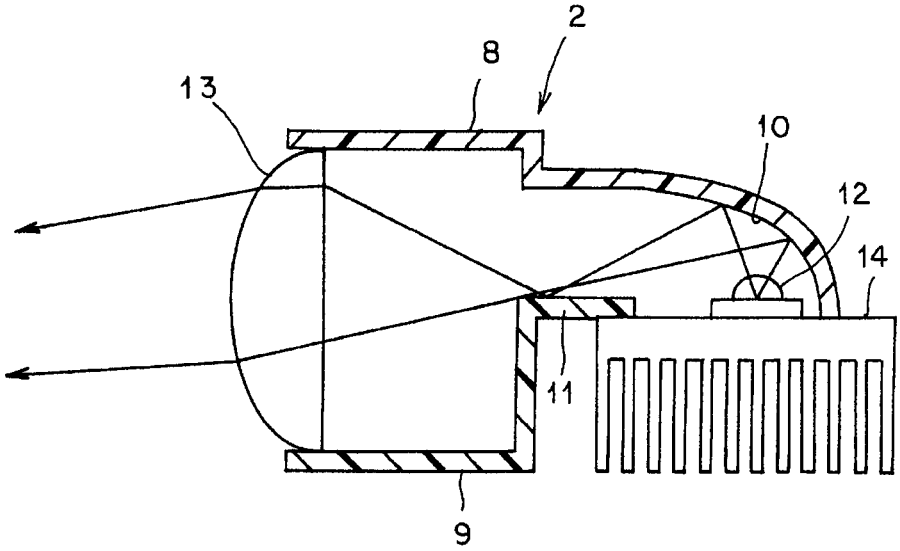
FIG. 3 is a vertical cross sectional view (longitudinal cross sectional view) of a lamp unit used in the head lamp, similarly.

The lamp unit 2 constitutes a light illuminating portion for externally illuminating light through the lamp lens 4. The lamp unit 2 illuminates (radiates, emits) a predetermined light distribution pattern, a light distribution pattern for passing, in the embodiment. The lamp unit 2, as shown in FIG. 3, is of a projector type, and forms a unitary structure. The lamp unit 2 is made up of; an upper reflector 8 and a lower reflector 9; a reflecting surface 10 and a shade 11; a semiconductor-type light source 12; a projecting lens (convex lens, focusing lens) 13; and a heat sink member 14.

The lamp unit 2 is mounted on the lamp housing 3 via a holder member 15, as shown in FIG. 2. A heat sink member 16 is provided in the lamp housing 3. The heat sink member 16 at the side of the lamp housing 3 and the heat sink member 14 at the side of the lamp unit 2 are connected to each other via the holder member 15 and the lamp housing 3.

The semiconductor-type light source 12 uses a self-emitting semiconductor-type light source such as an LED or an EL (organic EL). (The LED is used in the first embodiment). Thus, a heat is generated in the semiconductor-type light source 12 per se, whereas a heat due to the light from the semiconductor-type light source 12 is hardly generated. Therefore, snow, ice, or cloud is prone to adhere onto the lamp lens 4.

The lamp lens 4 is a substantially plain lens, and it is a so called outer cover (outer lens). The lamp lens 4 is molded from a synthetic resin such as PC (polycarbonate), for example, in the embodiment. In addition, the lamp lens 4, as shown in FIG. 2, is slanted (inclined) from top to bottom, from rear to front, on a longitudinal cross section (vertical cross section). Further, the lamp lens 4 is formed in a sectional concave shape, and is made up of: a front part (or frontal part) 33 through which the light illuminated from the lamp unit 2 permeates; and a side wall part 34 integrally extended rearwardly of the entire peripheral rim of the front part 33. A corner part is formed between the front part 33 and the side wall part 34. An interior face of the front part 33 is curved. In addition, the side wall part 34 is formed in an erected-wall shape. In a case where the lamp lens 4 is made of PC, a heat resistance temperature of the lamp lens 4 is 130 degrees Celsius.

Figure 5:
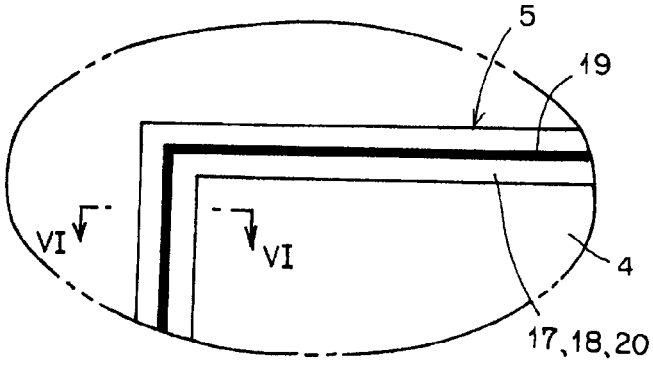
FIG. 5 is an enlarged view taken along the line V of FIG. 4, similarly.
Figure 6:
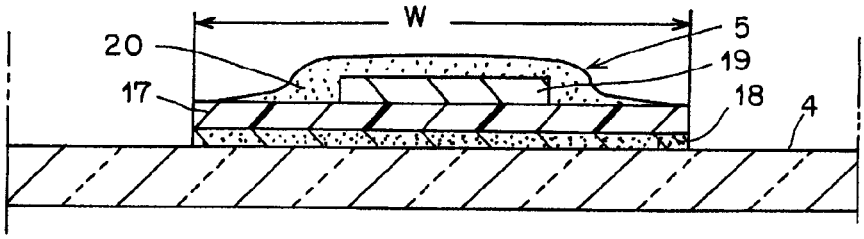
FIG. 6 is a cross-sectional view taken along the line VI-VI of FIG. 5, similarly.

The wire heater 5 is a transfer-type wire heater, and is provided by means of transfer on an interior face of the front part 33 of the lamp lens 4. The wire heater 5 provided by means of transfer on the interior face of the front part 33 of the lamp lens 4, as shown in FIGS. 5, 6, and 16, are made up of: a base film (film for heater) 17; an adhesive (adhesive layer) 18; an electrically conductive paste 19 for heater as an electrically conductive member for heater; and a resist 20. In addition, it is preferable that the wire heater 5 is optically permeable.

The base film 17 is made of a transparent film made of a synthetic resin, for example, PET (polyethylene terephthalate). The adhesive 18 is provided on one face of the base film 17.

On the other face of the base film 17, the electrically conductive paste 19 for heater is formed in a wiring pattern. The wiring pattern of the electrically conductive paste 19 for heater, as shown in FIG. 4, in the embodiment, is a wiring pattern in which upper and lower four transverse wires substantially parallel to each other are continuous from the left to the right in a zigzag pattern, via two left-side longitudinal wires and one right-side longitudinal wire. From the right side of the top and bottom two transverse wires, two longitudinal wires are continuously formed as a terminal part. The electrically conductive paste 19 for heater is an electrically conductive ink, and is made of a metal paste such as a silver paste, a gold paste, a copper paste, or an aluminum paste, in the embodiment. A power current is fed, whereby the electrically conductive paste 19 for heater generates heat due to an electrical resistance of the electrically conductive paste.

On the other face of the base film 17, the resist 20 is provided so as to cover the electrically conductive paste 19 for heater. The resist 20 is adapted to electrically insulate the electrically conductive paste 19 for heater and protect from an external shock. In other words, this resist is a surface protection coat of the electrically conductive paste 19 for heater. The resist 20 is made of a urethane-based or an acryl-based adhesive in the embodiment.

At least either of the base film 17 and the resist 20 is colored. In other words, a colored layer is provided on one face or the other face of the base film 17. Alternatively, the base film 17 per se or the resist 20 per se is colored.

The base film 17 (including the adhesive 18 in the embodiment) is cut in a pattern that follows a wire pattern of the electrically conductive paste 19 for heater. A width W of the cut base film 17 is about 0.5 mm in the embodiment, and is substantially equal to that of the resist 20. As shown in FIG. 16, after the base film 17 has been cut, the adhesive 18 is adhered to the interior face of the front part 33 of the lamp lens 4, and the electrically conductive adhesive paste 19 for heater, of a wire pattern, is transferred to the interior face of the front part 33 of the lamp lens 4, using a separator 21 which is disposed at the side of the resist 20. In this manner, the wire heater 5 is provided by means of transfer on the interior face of the front part 33 of the lamp lens 4.

The separator 21, as shown in FIG. 16, is released from the side of the resist 20 after the electrically conductive paste 19 for heater of the wire pattern has been transferred to the interior face of the front part 33 of the lamp lens 4. The separator 21 is shaped like a sheet having a size and a shape to an extent such that the wire heater 5 formed in the patterned shape that follows the wire pattern of the electrically conductive paste 19 for heater can be placed and can be transferred onto the interior face of the front part 33 of the lamp lens 4. In addition, the separator 21 is made of a flexible material, a rubber material such as urethane in the embodiment so that it can follow a curved interior face of the front part 33 of the lamp lens 4.

At the wire heater 5, the extension portion 6 and the power-feeding portion 50 are provided as shown in FIGS. 4 and 7 to 9. Like the wire heater 5, the extension portion 6 and the power-feeding portion 50 are provided on the interior face (at the side of the lamp room 7) of the front part 33 and the side wall part 34 of the lamp lens 4. In addition, the power-feeding part 50 is provided at a part which less influences a design of the lamp lens 4, i.e., at the side wall part 34 of the lamp lens 4.

The extension portion 6 is integrally provided by a predetermined length from the wire heater 5 (i.e., by a predetermined length within a sufficient reach from: the wire heater 5 in which the power-feeding portion 50 is provided at the front part 33 of the lamp lens 4: to the side wall part 34 of the lamp lens 4). The extension portion 6 is made up of an extension film 24 and an electrically conductive paste 25 for extension as an electrically conductive member for extension. The extension film 24 is integrally provided by a predetermined length from the base film 17 of the wire heater 5. The electrically conductive paste 25 for extension is formed on two wire patterns on one face of the extension film 24, and, at one end thereof, is electrically connected to a terminal part of the electrically conductive paste 19 for heater.

Figure 8:
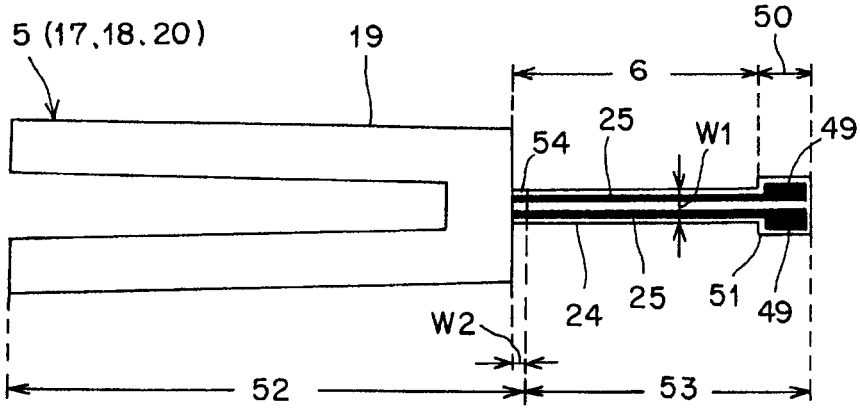
FIG. 8 is a plan view showing a wire heater, an extension portion, and the power-feeding portion, similarly.
Figure 9:
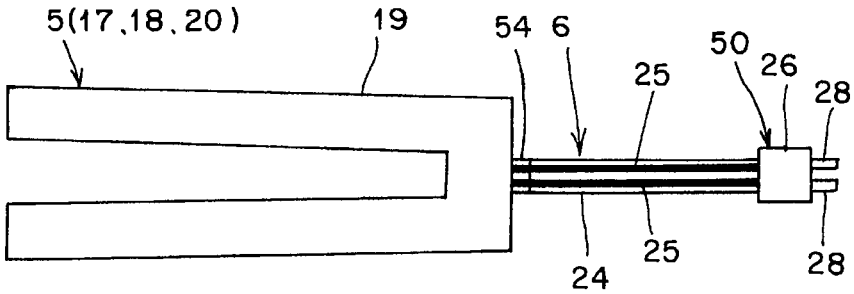
FIG. 9 is a plan view showing the wire heater, the extension portion, the power-feeding portion, and a connector, similarly.
Figure 10:
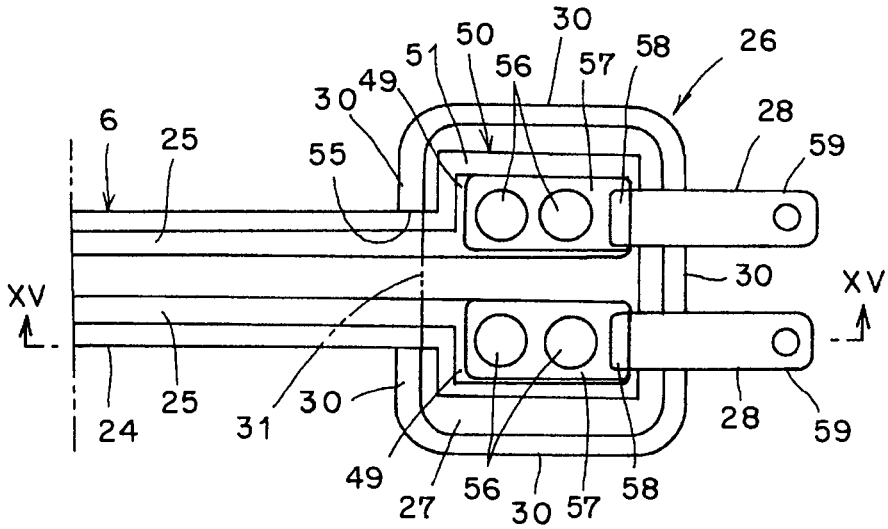
FIG. 10 is a plan view showing a part of the extension portion, the power-feeding portion, and the connector, similarly.

As shown in FIG. 8, an adhesive part 54 to be adhered to the lamp lens 4 is provided at a part of the other face of the extension film 24 of the extension portion 6 (i.e., a face opposite to the lamp lens 4). The adhesive part 54 of the extension portion 6 is provided at the side of the wire heater 5, and is adhered to the front part 33 of the lamp lens 4 together with the adhesive 18 of the wire heater 5. The adhesive part 54 of the extension portion 6 may be provided at an arbitrary position of the extension portion 6. A width W2 of the adhesive part 54 of the extension portion 6 is about 1 to 5 mm in the embodiment. In the adhesive part 54 of the extension portion 6, an adhesive layer is provided on the other face of the extension film 24 of the extension portion 6. As a result, the adhesive 18 of the wire heater 5 and the adhesive part 54 of the extension portion 6 constitute an adhesive layer part 52, whereas a part other than the adhesive part 54 of the extension portion 6 and the power-feeding portion 50 constitute a non-adhesive part 53. The power-feeding portion 50 may be an adhesive layer part. In this case, a part other than the adhesive part 54 of the extension portion 6 becomes a non-adhesive layer part. In addition, an adhesive layer may be provided entirely on the other face of the extension film 24 of the extension portion 6. In this case, in an adhesive layer other than the adhesive part 54 of the extension portion 6, a transparent letterpress-printed film pattern 55 with predetermined thickness is linearly filmed.

The power-feeding portion 50 is provided at a tip end part of the extension portion 6, and feeds power to the wire heater 5 via the extension portion 6. Four circular through holes 63 are provided in the power-feeding portion 50. The power-feeding portion 50 is made up of: a power-feeding film 51; a power-feeding electrically conductive paste 49 as a power-feeding electrically conductive member; and a connector 26. The power-feeding film 51 is integrally provided at a tip end part of the extension film 24 of the extension portion 6. The power-feeding electrically conductive paste 49 is formed on two wire patterns on one face of the power-feeding film 51, and, at one end thereof, is electrically connected to the other end (tip end) of a respective one of the two electrically conductive paste 25 for extension, of the extension portion 6. The connector 26 is electrically connected to the power-feeding electrically conductive paste 49 and is fixed to the side wall part 34 of the lamp lens 4 together with the power-feeding film 51.

The extension film of the extension portion 6 is integrally extended from the base film 17 of the wire heater 5. On the other hand, the power-feeding film 51 of the power-feeding portion 50 is integrally extended from the extension film 24 of the extension portion 6. Like the base film 17, the extension film 24 and the power-feeding film 51 are made of a transparent film made of a synthetic resin, for example, PET (polyethylene terephthalate). The width W1 of the extension film 24 is about 10 mm, in the embodiment, with respect to the width W (about 0.5 mm) of the base film 17. In addition, the length of the extension film 24 is a length to an extent such that the power-feeding film 51 reaches from the base film 17 to the side wall part 34 of the lamp lens 4. While, in FIG. 4, it is shown that a left end part of the extension film 24 is positioned more leftward than the wire heater 5, the left end part of the extension film 24 and the wire heater 5 are actually positioned on a substantially same line. On the other hand, the width of the power-feeding film 51 is greater than the width W1 of the extension film 24. In addition, the length of the power-feeding film 51 is smaller than that of the extension film 24.

Like the electrically conductive paste 19 for heater, the electrically conductive paste 25 for extension of the extension portion 6 and the power-feeding electrically conductive paste 49 of the power-feeding portion 50 are electrically conductive ink, and are made of a metal paste such as a silver paste, a gold paste, a copper paste, or an aluminum paste in the embodiment. The width of a respective one of the electrically conductive paste 25 for extension and the power-feeding electrically conductive paste 49 is greater than that of the electrically conductive paste 19 for heater and the length of a respective one of the electrically conductive paste 25 for extension and the power-feeding electrically conductive paste 49 is shorter than that of the electrically conductive paste 19 for heater, whereby their electrical resistance value is smaller than that of the electrically conductive paste 19 for heater. The width of the power-feeding electrically conductive paste 49 is greater than that of the electrically conductive paste 25 for extension, and the length of the power-feeding electrically conductive paste 49 is shorter than that of the electrically conductive paste 25 for extension.

On one face of a respective one of the extension film 24 and the power-feeding film 51, a resist (not shown) may be provided so as to cover a respective one of the electrically conductive paste 25 for extension and the power-feeding electrically conductive paste 49. Like the resist 20, the resist is adapted to electrically insulate the electrically conductive paste 25 for extension and the power-feeding electrically conductive paste 49 and protect from an external shock. In other words, the resist is a surface protection coat of the electrically conductive paste 25 for extension and the power-feeding electrically conductive paste 49. Like the resist 20, the abovementioned resist is made of a urethane-based or acryl-based adhesive in the embodiment.

In addition, at least one of the extension film 24 and the power-feeding film 51 or the resist is colored. In other words, a colored layer is provided on one face and/or the other face of a respective one of the extension film 24 and the power-feeding film 51. Alternatively, the extension film 24 and the power-feeding film 51 per se or the resist per se are/is colored.

The connector 26 is electrically connected to the power-feeding electrically conductive paste 49 and is fixed to the power-feeding film 51. The connector 26, as shown in FIGS. 4, 7, and 9 to 15, is made up of: one resin board 27 made of an insulation member, for example a resin (or resin board, base, etc.); two male terminals 28 made of a metal, for example an electrically conductive member; and two grommeted terminal boards 29 (or grommeted terminal or grommet).

The male terminal 28 is set to the power-feeding electrically conductive paste 49 on one face of the power-feeding film 51 of the power-feeding portion 50. The male terminal 28 is made of a fixing portion 57, a bridge portion 58, and a male portion 59. Two circular through holes 60 are provided in the fixing portion 57. One circular through hole is also provided in the male portion 59.

The grommeted terminal board 29 is adapted to swage the terminal 28 and the power-feeding portion 50. The grommeted terminal board 29 is made of a base portion 61 and two hollowed swaging portions 62. The swaging portion 62 is inserted through the through hole 63 of the power-feeding portion 50 and the through hole 60 of the male terminal 28.

The resin board 27 constitutes a secondary swaging tool for swaging the terminal, the power-feeding portion, and the grommeted terminal board. The resin board 27 is shaped like a rectangular plate, for example. Ribs 30 are integrally provided on four edges of one face of the base 27. A cutout 55 having a width equal to the width W1 of the extension portion 6 is provided at one edge of the rib 30. On one face of the resin board 27, four rod-like or round rod-like swaging protrusions 56 are integrally protruded. The swaging protrusions 56 each are adapted to be inserted through a hollow of the hollowed swaging portion 62 of the grommeted terminal board 29.

Hereinafter, a description will be given with respect to procedures for assembling of: the power-feeding film 51 of the power-feeding portion 50 and the two power-feeding electrically conductive pastes 49; and the resin board 27 of the connector 26 and the two male terminals 28 and the two grommeted terminal boards 29.

Figure 11:
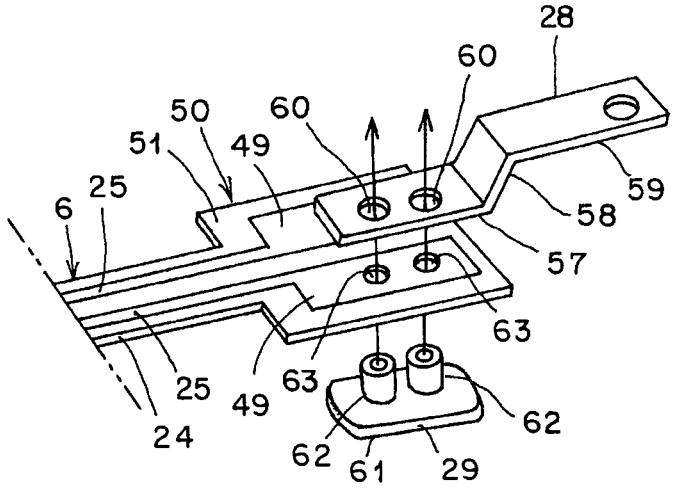
FIG. 11 is a perspective view showing a part of the extension portion, the power-feeding portion, and a male terminal and a grommeted terminal board of the connector, similarly.
Figure 12:
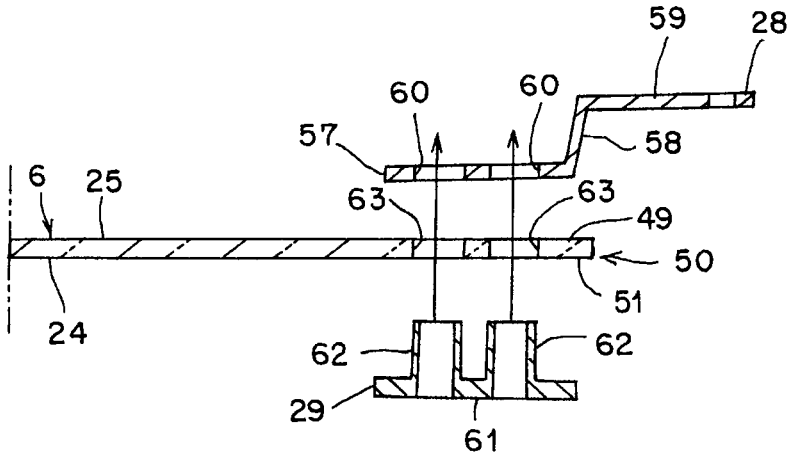
FIG. 12 is a cross-sectional view showing a part of the extension portion, the power-feeding portion, and a male terminal and a grommeted terminal board of the connector, similarly.
Figure 13:
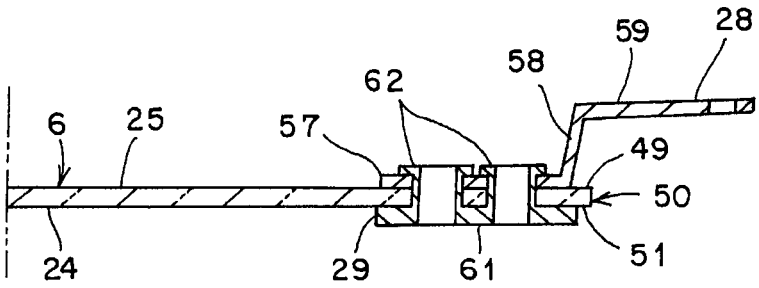
FIG. 13 is a cross-sectional view showing a state in which the power-feeding portion and the male terminal are swaged and fixed by the grommeted terminal board, similarly.

First, the fixing portions 57 of the two male terminals 28 are set to the two power-feeding electrically conductive pastes 49 of the power-feeding portion 50. At this time, the through hole 63 of the power-feeding portion 50 is aligned with the through hole 60 of the male terminals 28. The swaging portion 62 of the two grommeted terminal boards 29 is inserted from the side of the power-feeding film 51 into the through hole 63 of the power-feeding portion 50 and the through hole 60 of the male terminal 28 (See FIGS. 11 and 12. In FIG. 11, one male terminal 28 and one grommeted terminal board 29 are shown.)

Next, a tip end part of the swaging portion 62 of the two grommeted terminal boards 29 is crushed. At this time, the hollow of the swaging portion 62 is kept unchanged in shape. As a result, the power-feeding portion 50 and the two male terminals 28 are swaged between the base portion 61 of the two grommeted terminal boards 29 and a tip end part of the crushed swaging portion 62. In this manner, the power-feeding portion 50 and the two male terminals 28 are fixed by means of a primary swaging of the two grommeted terminal boards 29 (see FIG. 13). At this time, the power-feeding portion 50 and the two male terminals 28 and the two grommeted terminal boards 29 are integrally fixed to each other. In addition, the two power-feeding electrically conductive pastes 49 of the power-feeding portion 50 and the fixing portion 57 of the two male terminals 28 are electrically connected to each other.

Figure 14:
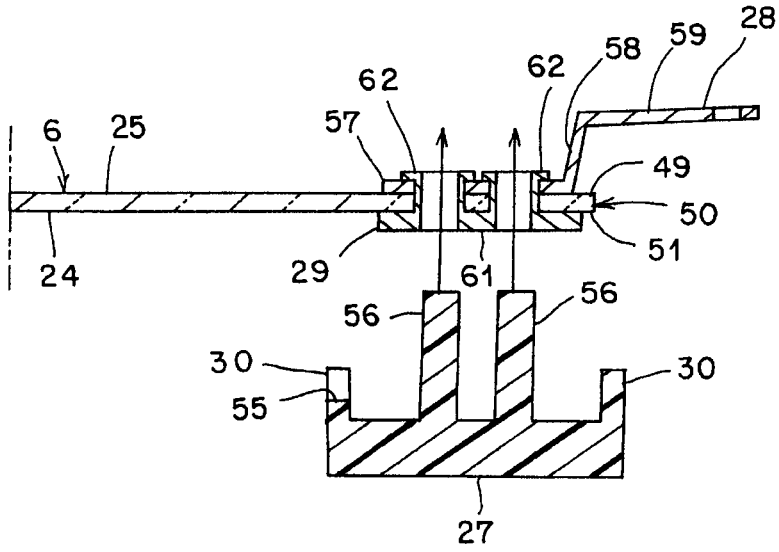
FIG. 14 is a cross-sectional view showing the power-feeding portion and male terminal and the grommeted terminal board and a resin board are integrally swaged and fixed to each other, similarly, the cross-sectional view being taken along the line XV-XV of FIG. 10.

Next, the swaging protrusion 56 of the resin board 27 is inserted from the side of the power-feeding film 51 into a hollow of the swaging portion 62 of the two grommeted terminal boards 29 on which the power-feeding portion 50 and the two male terminals 28 are fixed to each other by means of the primary swaging (see FIG. 14). At this time, the base portion 61 of the two grommeted terminal boards 29 on which the power-feeding portion 50 and the two male terminals 28 are fixed by means of the primary swaging and the power-feeding portion 50; and the fixing portion 57 of the two male terminals 28, are placed on one face of the resin board 27 surrounded by the ribs 30.

Afterwards, a tip end part of the swaging protrusion 56 of the resin board 27 is crushed. As a result, the power-feeding portion 50 and the two male terminals 28 and the two grommeted terminal boards 29, fixed by the two grommeted terminal boards 29 by means of the primary swaging, are swaged between the resin board 27 and the crushed tip end part of the swaging protrusion 56. In this manner, the power-feeding portion 50 and the two male terminals 28 and the two grommeted terminal boards 29, are fixed by means of a secondary swaging of the resin board 27 (see FIG. 15). At this time, the power-feeding portion 50 and the two male terminals 28; and the two grommeted terminal boards 29 and the resin board 27, are integrally fixed to each other. As a result, the connector 26 is electrically connected to the power-feeding electrically conductive paste 49 of the power-feeding portion 50, and is fixed to the power-feeding film 51 of the power-feeding portion 50.

Figure 15:
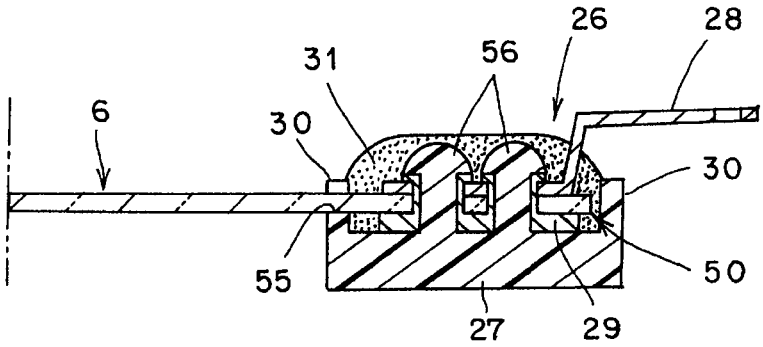
FIG. 15 is a cross-sectional view showing a state in which the power-feeding portion and the male terminal and the grommeted terminal board and the resin board are swaged and fixed and a sealant are provided, similarly.

As shown in FIG. 15, on one face of the resin board 27 surrounded by the ribs 30, for example, a sealant 31 made of silicon is provided so as to cover a part of the fixing portion 57 and the bridge portion 58 of the two grommeted terminal boards 29 and the two male terminals 28; the power-feeding film 51 and the power-feeding electrically conductive paste 49 of the power-feeding portion 50 and the crushed tip end part of the swaging protrusion 56 of the resin board 27. At this time, the sealant 31 is surrounded by the ribs 30 (excluding the cutout 55) on four edges of one face of the resin board 27, thus making it possible to reliably cover the two power-feeding electrically conductive pastes 49 which are electrically connecting portions; and the fixing portion 57 of the two male terminals 28 and the two grommeted terminal boards 29. The sealant 31 is adapted to cover and electrically insulate the two power-feeding electrically conductive pastes 49 which are electrically conductive portions and protect from an external shock; and the fixing portion 57 of the two male terminals 28 and the two grommeted terminal boards 29. In a case where a resist is provided on one face of the power-feeding film 51, such resist is not provided at a part at which the fixing portion 57 of the two male terminals 28 is set among the two power-feeding electrically conductive pastes 49 which are electrically connecting portions. In this manner, the power-feeding film 51 and the two power-feeding electrically conductive pastes 49, of the power-feeding portion 50; and the resin board 27 and the two male terminals 28 and the two grommeted terminal boards 29, of the connector 26, are assembled.

The other face of the resin board 27 is adhesively fixed to an interior face of the side wall part 34 of the lamp lens 4, by means of an adhesive 32 such as a double-sided tape (double-sided adhesive tape) having sufficient durability. Apart from the adhesive 32, for example, by means of deposition welding or screw tightening, the resin board 27 may be fixed to the interior face of the side wall part 34 of the lamp lens 4. As a result, in the power-feeding portion 50, the connector 26 is fixed to an interior face of the side wall part 34 of the lamp lens 4 together with the power-feeding film 51. In this manner, the extension portion 6 is provided on an interior face of a respective one of the front part 33 and the side wall part 34, of the lamp lens 4, and the power-feeding portion 50 is provided on an interior face of the side wall part 34 of the lamp lens 4.

Figure 7:
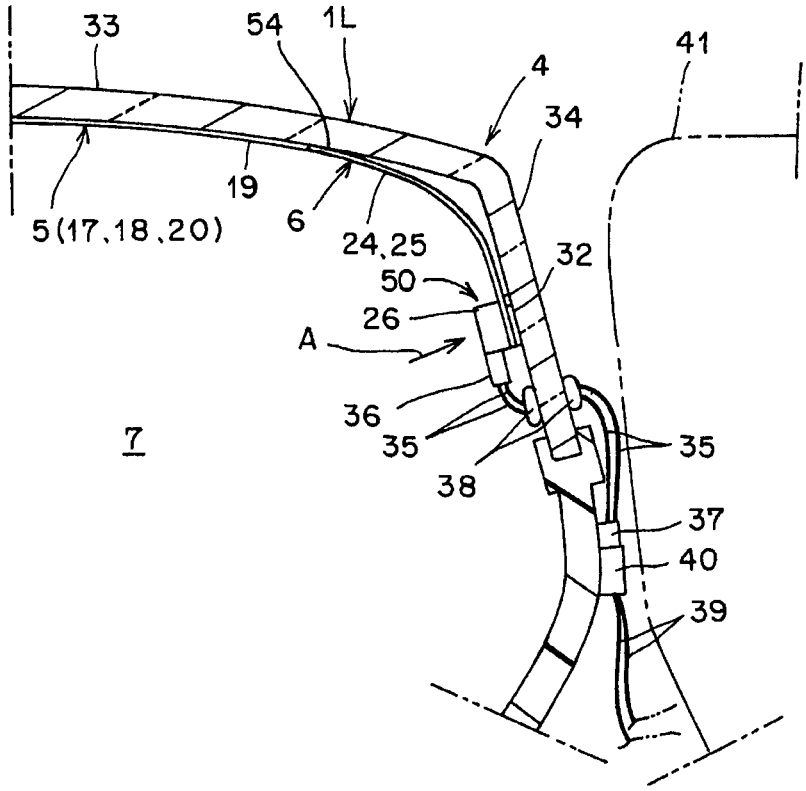
FIG. 7 is a horizontal cross-sectional view (transverse cross sectional view) showing a part of the head lamp, in particular, showing a state of wiring between a power-feeding portion and a power source side, similarly.

At this time, as shown in FIG. 7, both ends of the extension film 24 of the extension portion 6 are fixed, respectively, via the wire heater 5 and the adhesive part 54 and the connector 26, onto an interior face of the front part 33 of the lamp lens 4 and an interior face of the side wall part 34. In addition, an intermediate part of the extension film 24 of the extension portion 6 is bent along a corner between the front part 33 and the side wall part 34, of the lamp lens 4. As a result, the intermediate part of the extension film 24 of the extension portion 6 is reliably maintained in a state in which it is bent along the corner of the lamp lens 4, by means of a resilient restoration force (see the arrow "A" indicated by the solid line in FIG. 7). In this manner, the extension portion 6 is reliably fixed onto the interior face of the front part 33 and the side wall part 34, of the lamp lens 4.

As shown in FIG. 7, two heater-side harnesses 35 are electrically connected to the connector 26. In other words, a respective one of two female terminals 36 made of an electrically conductive member, for example a metal, is mounted and electrically connected to one end of a respective one of the two heater-side harnesses 35. The two female terminals 36 are removably coupled to the two male terminals 28 of the connector 26, respectively. As a result, the connector 26 and the heater-side harness 35 are electrically connected to each other.

As shown in FIG. 7, a heater-side connector 37 is mounted and electrically connected to the other end of a respective one of the two heater-side harnesses 35. The two heater-side harnesses 35 are pulled out from the inside of the lamp room 7 to the outside of the lamp room 7, via a waterproof structure provided at the side wall part 34 of the lamp lens 4, for example via a rubber-based waterproof grommet 38 in the embodiment. The two heater-side harnesses 35 may be pulled out from the inside of the lamp room 7 to the outside of the lamp room 7, via a waterproof structure provided in the lamp housing 3, for example via a rubber-based waterproof grommet (not shown) in the embodiment.

In FIG. 7, reference numeral 39 designates two power source-side harnesses, a respective one of which is electrically connected to a power source at one end thereof. A power source-side connector 40 is mounted and electrically connected to the other end of a respective one of the two power source-side harnesses 39. The heater-side connector 37 is removably connected to the power source-side connector 40. As a result, the wire heater 5 is electrically connected to a power source via the power-feeding portion 50 and the extension portion 6.

The power source-side connector 40 is fixed outside of the lamp room 7 of the lamp housing 3. As a result, part of the heater-side harness 35, the heater-side connector 37, the power source-side connector 40, the power source-side harness 39 are positioned outside of the lamp room 7 of the lamp housing 3.

Outside of the headlamp 1L of the vehicle lighting device according to the first embodiment, other vehicle parts 41

(such as another vehicle lighting device, a bumper, decorative parts, for example) are provided adjacently. A part of the heater-side harness 35, the heater-side connector 37, the power source-side connector 40, the power source-sided harness 39, positioned outside of the lamp room 7 of the lamp housing 3, cannot be seen from the outside because they are positioned between the headlamp 1L of the vehicle lighting device according to the first embodiment and other vehicle parts 41; and therefore, there is no problem on appearance.

The wire heater 5 is connected to a manual switch (not shown) or an auto switch (not shown), via the extension portion 6 and the power-feeding portion 50. The manual switch is adapted to manually turn ON/OFF a power current feed to the wire heater 5. The auto switch is adapted to automatically turn ON/OFF a power current feed to the wire heater 5.

The auto switch is made up of a control portion such as ECU and a detection portion such as a temperature sensor or an optical sensor. The detection portion detects an ambient environment of an automobile C, for example a temperature outside of the automobile C or light illuminated from the lamp lens 4, and outputs the detection signal to the control portion. The control portion judges whether or not snow, ice, or cloud, etc., adheres to the lamp lens 4, based upon the detection signal from the detection portion or whether or not a temperature is reached to an extent such that snow, ice, or cloud adheres to the lamp lens 4. Afterwards, upon judging that snow, ice, or cloud, etc., adheres to the lamp lens 4 or upon judging that a temperature is reached to an extent such that snow, ice, or cloud, etc., adheres to the lamp lens 4, a power current is fed to the wire heater 5 via the power-feeding portion 50 and the extension portion 6. On the other hand, upon judging that no snow, ice, cloud, etc., adheres to the lamp lens 4 or upon judging that a temperature is not reached to an extent such that snow, ice, or cloud, etc., adheres to the lamp lens 4, a power current feed to the wire heater 5 via the power-feeding portion 50 and the extension portion 6 is interrupted.

A temperature control portion (not shown) is provided at one terminal portion of the wire heater 5. The temperature control portion controls a heating temperature of the electrically conductive paste 19 for heater. As the temperature control portion, for example, a PTC thermistor is used. This PTC thermistor has a feature that no power is fed if a temperature rises, a resistance value increases, and a predetermined resistance value is then reached. For example, in a case where the lamp lens 4 is made of polycarbonate (PC), a heat-resistance temperature of the lamp lens 4 is about 130 degrees Celsius, and thus, a PTC thermistor having a resistance feature that no power is fed at a time point when the heating temperature of the electrically conductive paste 19 for heater has reached around about 60 degrees Celsius is used as the temperature control portion.

Hereinafter, referring to FIG. 16, a description will be given with respect to a process of manufacturing the wire heater 5 to be transferred to the lamp lens 4 of headlamps 1L, 1R of the vehicle lighting device according to the first embodiment (the extension portion 6 and the power-feeding portion 50 are included, but are not shown in FIG. 16) and a transfer process of transferring the wire heater 5 to the lamp lens 4. First, among films, the adhesive (adhesive layer, viscous layer) 18 and the adhesive part 54 (viscous layer) are provided at one face (bottom face) of a portion corresponding to the base film 17 and of a portion corresponding to a part of the extension film 24 (the adhesive part 54 of the extension portion); and the adhesive 18 and a sheet member 23 which is formed by releasably adhering a release sheet 22 such as a release film or release paper to the adhesive part 54 are manufactured (see FIG. 16A). The sheet member 23 has a size to an extent such that the wire heater 5 and the extension portion 6 and the power-feeding portion 50, shaped like a pattern that follows a wire pattern of the electrically conductive paste 19 for heater and the electrically conductive paste 25 for extension and the power-feeding electrically conductive paste 49, can be formed.

Figure 16A:
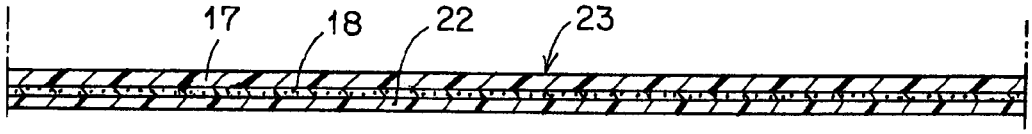
FIGS. 16A to 16G are explanatory views showing a process of manufacturing the wire heater to be transferred to the lamp lens and a transfer process of transferring the wire heater to the lamp lens, similarly.
Figure 16B:
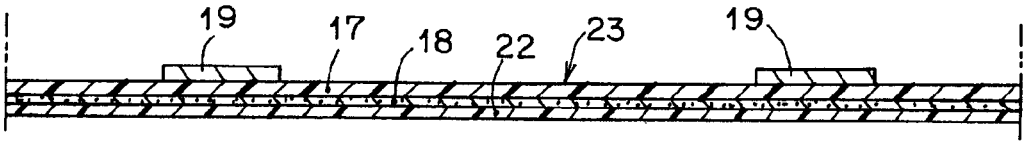

Next, on the base film 17 of the sheet member 23, and the other face (top face) of the extension film 24 extended from the base film 17, and the power-feeding film 51, the electrically conductive paste 19 for heater, the electrically conductive paste 25 for extension, and the power-feeding electrically conductive paste 49 are printed by means of a processing technique such as screen printing or hot stamp printing, and the printed pastes are formed on a wire pattern (see FIG. 16B).

Figure 16C:
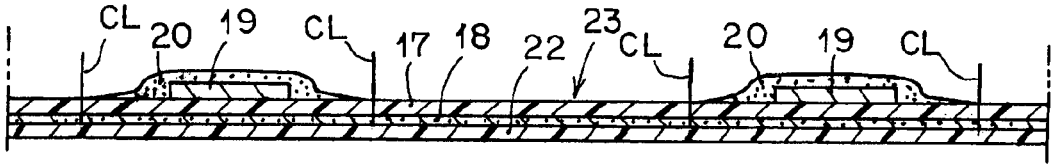

Subsequently, on the other face (top face) of the base film 17 of the sheet member 23, the resist (insulation layer-compatible protection film) 20 is printed by means of the processing technique such as screen printing or hot stamp printing, for example, and the printed resist is provided so as to cover the electrically conductive paste 19 for heater (see FIG. 16C). At this time, on the extension film 24 and the other face (top face) of the power-feeding film 51, the resist (insulation layer-compatible protection film) is printed simultaneously by means of the processing technique such as screen printing or hot stamp printing, whereby the resist may be provided so as to cover the electrically conductive paste 25 for extension and the power-feeding electrically conductive paste 49.

Figure 16D:
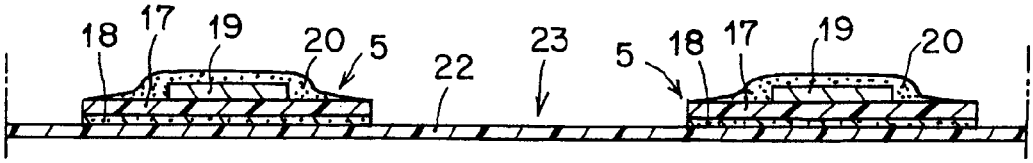
Figure 16E:
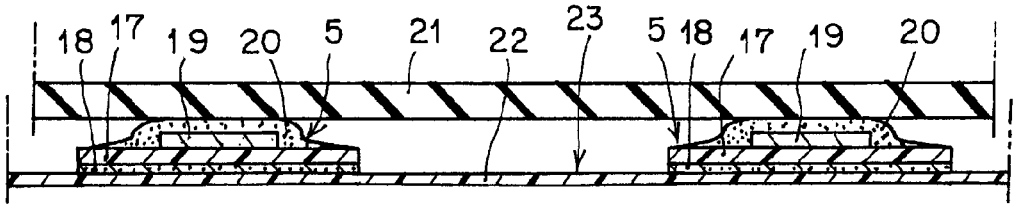
Figure 16F:
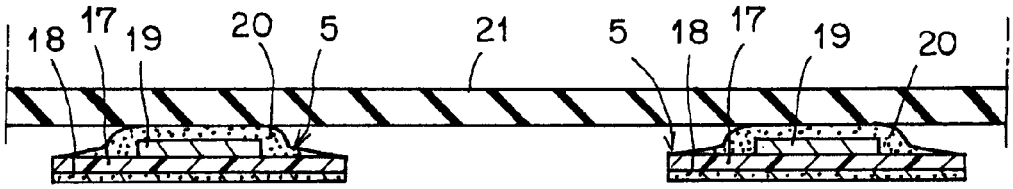
Figure 16G:
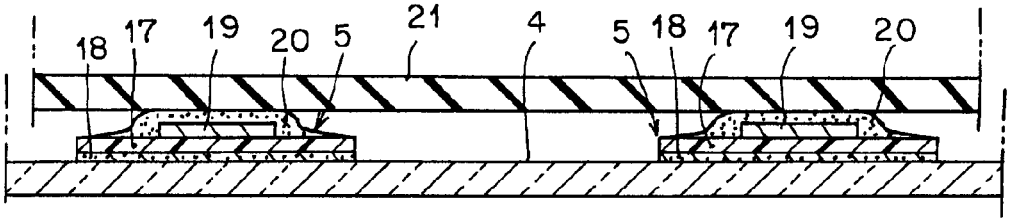

Afterwards, the base film 17 of the sheet member 23 and the adhesive 18 are cut in a pattern that follows a wire pattern of the electrically conductive paste 19 for heater by means of punching processing, for example (see FIG. 16D). In other words, a cutter (not shown) is pushed from the side of the resist 20 into the base film 17 and the adhesive 18 and is stopped at a boundary between the adhesive 18 and the release sheet 22, and the base film 17 and the adhesive 18 are cut. In FIG. 16C, the solid line CL indicates a cut part of the base film 17 and the adhesive 18. The cutter is released from the sheet member 23 and, among the cut base film 17 and adhesive 18, a redundant portion other than a portion of the pattern that follows a wire pattern of the electrically conductive paste 19 for heater is released from the release sheet 22. At this time, the extension film 24 is cut in a predetermined width W1 and in a predetermined length, and simultaneously, the power-feeding film 51 is also cut in a predetermine width and in a predetermined length.

In this manner, as shown in FIG. 16D, there are left: the release sheet 22 of the sheet member 23 that has not been cut; the base film 17 and the adhesive 18 having been cut in the pattern that follows the wire pattern of the electrically conductive paste 19 for heater; the electrically conductive paste 19 for heater of the wire pattern; and the resist 20 provided in the pattern that follows the wire pattern of the electrically conductive paste 19 for heater. A cut width W of the base film 17 and the adhesive 18 is a width substantially equal to that of the resist 20 in the embodiment; a width defined to an extent such that the resist 20 can cover the electrically conductive paste 19 for heater, i.e., a width defined to an extent such that the resist 20 can seal and electrically insulate the electrically conductive paste 19 for heater and can protect from an external shock. The cut width of the base film 17 is not limitative to the cut width W.

After the base film 17 of the sheet member 23 and the adhesive 18 have been cut in the pattern that follows the wire pattern of the electrically conductive paste 19 for heater, the separator 21 is disposed at the side of the resist 20 (see FIG.

16E). In this manner, the release sheet 22 of the sheet member 23, which has not been cut; the base film 17 and the adhesive 18, having been cut in the pattern that follows the wire pattern of the electrically conductive paste 19 for heater; the electrically conductive paste 19 for heater of the wire pattern; and the resist 20 provided in the pattern that follows the wire pattern of the electrically conductive paste 19 for heater, are placed on the separator 21 with the side of resist 20 being oriented downwardly. As a result, a unit of the wire heater 5 (including the extension portion 6 and the power-feeding portion 50) is manufactured. The unit is made of: the wire heater 5 (including the extension portion 6 and the power-feeding portion 50), made up of: the base film 17 and the adhesive 18; and the electrically conductive paste 19 for heater and the resist 20; and the separator 21 and the release sheet 22 of the sheet member 23.

Next, the release sheet 22 of the unit manufactured as described above is released (see FIG. 16F). Afterwards, using the separator 21 disposed at the side of the resist 20, the adhesive 18 is adhered to an interior face of the lamp lens 4, and the electrically conductive paste 19 for heater of the wire pattern is transferred to an interior face of the front part 33 of the lamp lens 4 (see FIG. 16G). The separator 21 is then released from the resist 20. In this manner, as shown in FIGS. 4 to 7 and 12, the wire heater 5 is transferred to the interior face of the front part 33 of the lamp lens 4. At this time, a part at the side of the wire heater 5 of the extension portion 6 is adhered to the interior face of the front part 33 of the lamp lens 4 by means of the adhesive 54.

The vehicle lighting device according to the first embodiment is made of the above-described constituent elements. Hereinafter, a functional description of these constituent elements will be given.

Semiconductor-type light sources 12 of five lamp units 2 are lit, respectively. The light from the semiconductor-type light sources 12 of the five lamp units 2 is then reflected on a reflecting surface 10 of an upper reflector 8; a part of the reflected light is cut off by means of a shade 11 of a lower reflector 9; and remains of the reflected light passes through a projecting lens 13 and the front part 33 of the lamp lens 4, and is externally illuminated in a predetermined light distribution pattern having a cutoff line, i.e., in a light distribution pattern for passing. This cutoff line of the light distribution pattern for passing is formed by an edge of the shade 11. In addition, the reflected light from the reflecting surface 10, the reflected light having been reflected on the reflecting surface of the shade 11, can be utilized by providing a reflecting surface on the shade 11.

A wire heater 5 provided for transfer on the front part 33 of the lamp lens 4 is made of a linear pattern, thus allowing an optical loss or an influence of light distribution, etc., to be minimized when light passes through the front part 33 of the lamp lens 4. Moreover, a lamp unit 2 employing a semiconductor-type light source 12 as a light source is used, thus reducing a width of the light illuminated from the lamp unit 2. Therefore, the light with its small width is passed between linear patterns of the wire heater 5, thereby making it possible to further prevent an optical loss or an influence of light distribution, etc.

A heat is hardly generated to the light from the semiconductor-type light source 12, thus allowing snow, ice, or cloud to easily adhere to the lamp lens 4. In this case, by means of a manual switch and an auto switch, a power current is fed to the wire heater 5 provided by means of transfer at the front part 33 of the lamp lens 4 via the power-feeding portion 50 and the extension portion 6.

When the power current is fed to the wire heater 5, the wire heater 5 generates a heat, due to an electrical resistance of the wire heater 5. Owing to a heat generation effect of this wire heater 5, the lamp lens 4 is warmed, the adhering of snow, ice, or cloud to the lamp lens 4 is prevented, or the snow, ice, or cloud adhering to the lamp lens 4 is melted or removed. As a result, a loss of the light illuminated from the front part 33 of the lamp lens 4 can be prevented.

At this time, due to a snowball effect that, by melting the snow or ice at a part corresponding to the electrically conductive paste 19 for heater, of the front part 33 of the lamp lens 4, the melted snow or ice slides on a surface of the front part 33 of the lamp lens 4, the snow or ice adhering to a part which does not correspond to the electrically conductive paste 19 for heater, of the front part 33 of the lamp lens 4, is stripped off from the surface of the front part 33 of the lamp lens 4. As a result, the snow, ice, or cloud adhering to the lamp lens 4 can be reliably removed.

If the heat generation temperature of the wire heater 5 reaches a predetermined temperature in the heat generation effect of the wire heater 5, the feeding of a power current to the wire heater 5 is controlled, and the heat generation temperature of the wire heater 5 is retained at a temperature close to the predetermined temperature due to a temperature control effect of a temperature control portion. As a result, a lamp lens 4 made of resin with a comparatively low heat resistance temperature can be protected from overheat.

After the adhering of snow, ice, or cloud to the lamp lens 4 has been prevented and the snow, ice, or cloud having adhered to the lamp lens has been melted or removed, the power current feeding to the wire heater 5 provided on the lamp lens 4 is interrupted by means of a manual switch or/and an auto switch.

The vehicle lighting device according to the first embodiment is made of the above-described constituent elements and functions. Hereinafter, advantageous effect(s) of the vehicle lighting device will be described.

In the vehicle lighting device according to the first embodiment, a connector 26 is formed in such a manner that a male terminal 28 and a power-feeding portion 50 is fixed by the primary swaging of a grommeted terminal board 29, and further, the male terminal 28, the power-feeding portion 50, and the grommeted terminal board 29 are fixed by the secondary swaging of a resin board 27. Thus, in the vehicle lighting device according to the first embodiment, a swaging fixing strength between the power-feeding portion 50 and the connector 26 can be improved by means of the primary swaging fixing of the grommeted terminal board 29 and the secondary swaging fixing of the resin board 27, in comparison with a connector formed such that a male terminal and a power-feeding portion are fixed by swaging a grommeted terminal board (swaging tool) or a connector in such a manner that a resin base, a terminal, and a power-feeding portion are fixed by swaging a grommeted terminal board (swaging tool).

In particular, in the vehicle lighting device according to the first embodiment, an extension portion 6 made up of an extension film 24 and an electrically conductive paste 25 for extension was provided between a wire heater 5 and the power-feeding portion 50, thus eliminating a harness. As a result, the vehicle lighting device according to the first embodiment can achieve lower manufacturing cost, in comparison with a vehicle lighting device in which a power-feeding portion is made of a harness. In addition, the vehicle lighting device solves a problem on durability that, due to the weight of the harness, the wire heater 5 transferred to the lamp lens 4 is released from the lamp lens 4, a load is applied on the wire heater 5, or the lamp lens 4 is damaged by the harness.

In addition, in the vehicle lighting device according to the first embodiment, by means of the extension portion 6 provided between the wire heater 5 and the power-feeding portion 50, the wire heater 5 and the power-feeding portion 50 can be provided, respectively, at other separate positions of the lamp lens 4, for example, at the front part 33 and the side wall part 34 of the lamp lens 4, respectively, with an electrical connection being maintained. As a result, in the vehicle lighting device according to the first embodiment, the wire heater 5 can be provided at a portion to be illuminated with light, i.e., at the front part 33, of the lamp lens 4; and the power-feeding portion 50 can be provided at an inconspicuous portion of the lamp lens 4, i.e., at a portion which is not illuminated with light, the portion being not required to provide the wire heater 5, for example, at the side wall part 34 to be mounted to a lamp housing. In this manner, in the vehicle lighting device according to the first embodiment, there is no need to provide the power-feeding portion 50 at a conspicuous portion of the lamp lens 4, i.e., at the front part 33. Thus, in particular, a problem, such as impairment on appearance or impairment on design in a frontal view of the lamp lens 4, can be solved. In addition, there is no need to provide the wire heater 5 at a position reaching up to an inconspicuous portion, i.e., up to the side wall part 34, of the lamp lens 4. Therefore, a problem on manufacturing cost or power consumption can also be solved.

Further, in the vehicle lighting device according to the first embodiment, by means of the extension portion 6 provided between the wire heater 5 and the power-feeding portion 50, the wire heater 5 and the power-feeding portion 50 can be fixed at other separate positions of the lamp lens 4, respectively, thus allowing the wire heater 5 to be reliably and easily transferred to the lamp lens 4. In other words, it is difficult to adjacently transfer the wire heater 5 and the power-feeding portion 50 having a larger width than that of the wire heater 5 to the lamp lens 4. However, in the vehicle lighting device according to the first embodiment, there is no need to adjacently fix the wire heater 5 and the power-feeding portion 50 having a larger width than that of the wire heater 5 to the lamp lens 4, thus allowing the wire heater 5 to be reliably and easily transferred to the lamp lens 4.

Furthermore, in the vehicle lighting device according to the first embodiment, of the extension film 24 of the extension portion 6, the adhesive part 54 was provided at a part of a face at a side opposite to the lamp lens 4, and thus, by means of the adhesive part 54 of such a part, the extension film 24 of the extension portion 6 can be reliably adhered to the interior face of the front part 33 of the lamp lens 4 and its appearance or design is never degraded. In other words, it is difficult to adhere the entirety of the extension film 24 of the extension portion 6 to a curved face of the interior face of the front part 33 of the lamp lens, and its appearance or design is degraded, or alternatively, if the extension film 24 of the extension portion 6 is not entirely adhered to the interior face of the front part 33 of the lamp lens 4, the wire heater 5 may be released from the interior face of the front part 33 of FIG. 4, of the lamp lens, with a load being applied to the adhesive 18 of the wire heater 5. However, in the vehicle lighting device according to the first embodiment, a part of the extension film 24 of the extension portion 6 is adhered to the interior face of the front part 33 of the lamp lens 4, thus allowing the extension film 24 of the extension portion 6 to be reliably adhered to the interior face of the front part 33 of the lamp lens 4 and never degrading its appearance or design.

Still furthermore, in the vehicle lighting device according to the first embodiment, the wire heater 5 is made up of the base film (film for heater) 17 and the electrically conductive paste 19 for heater, whereas the extension portion 6 is made up of the extension film 24 and the electrically conductive paste 25 for extension, and further, the power-feeding portion 50 is made up of the power-feeding film 51 and the power-feeding electrically conductive paste 49. Thus, in the vehicle lighting device according to the first embodiment, the base film (film for heater) 17 of the wire heater 5, the extension film 24 of the extension portion 6, and the power-feeding film 51 of the power-feeding portion 50; and the electrically conductive paste 19 for heater of the wire heater 5, the electrically conductive paste 25 for extension of the extension portion 6, and the power-feeding electrically conductive paste 49 of the power-feeding portion 50 can be manufactured in the same process, and there is no need for a new manufacturing process, thus making it possible to reduce the manufacturing cost accordingly.

Yet furthermore, in the vehicle lighting device according to the first embodiment, the adhesive part 54 of the extension portion 6 is provided at the side of the wire heater 5. Thus a load on the adhesive 18 of the wire heater 5 can be reduced by the adhesive part 54 of the extension portion 6 at the side of this wire heater 5, and the wire heater 5 can be prevented from being released from the lamp lens 4 accordingly.

Moreover, in the vehicle lighting device according to the first embodiment, a wire pattern of the electrically conductive paste 25 for extension of the extension portion 6 and a wire pattern of the power-feeding electrically conductive paste 49 of the power-feeding portion 50 each are thick and short in comparison with a wire pattern of the electrically conductive paste 19 for heater of the wire heater 5. Thus, the electrical resistance value of a respective one of the wire pattern of the electrically conductive paste 25 for extension of the extension portion 6 and the wire pattern of the power-feeding electrically conductive paste 49 of the power-feeding portion 50, is small in comparison with the electrical resistance value of the wire pattern of the electrically conductive paste 19 for heater of the wire heater 5. Accordingly, a power current can be fed to the wire heater 5 without a temperature rise in the wire pattern of the electrically conductive paste 25 for extension, of the extension portion 6, and that of the power-feeding electrically conductive paste 49 of the power-feeding portion 50. As a result, the vehicle lighting device according to the first embodiment can achieve power saving, and moreover, even if the electrically conductive paste 25 for extension of the extension portion 6 and the power-feeding electrically conductive paste 49 of the power-feeding portion 50 are electrically connected to the electrically conductive paste 19 for heater, of the wire heater 5, a design on the electrical resistance value of the wire pattern of the electrically conductive paste 19 for heater of the wire heater 5 is not influenced. (This wire pattern has thin and long wires, thus there being a limitation to uniformly obtaining the electrical resistance values all over the required parts).

Second Embodiment

Figure 17:
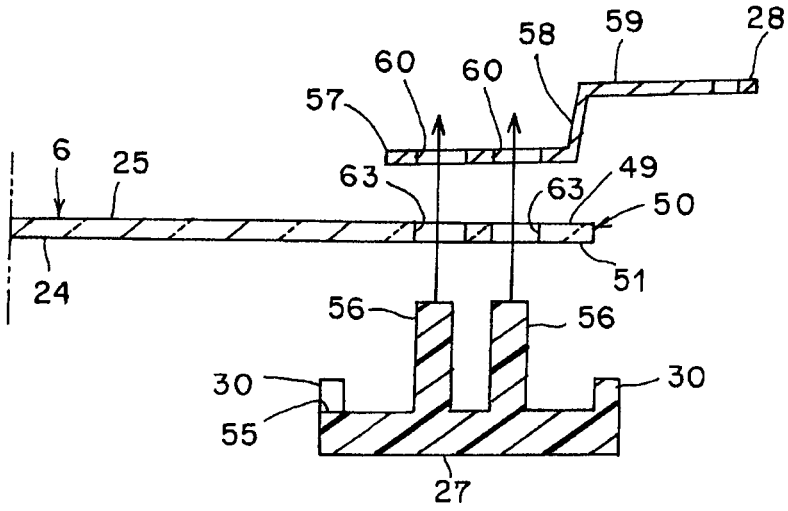
FIG. 17 is a cross-sectional view of the power-feeding portion and the male terminal and the resin board, shown in the second embodiment of the vehicle lighting device according to the present invention, similarly.
Figure 18:
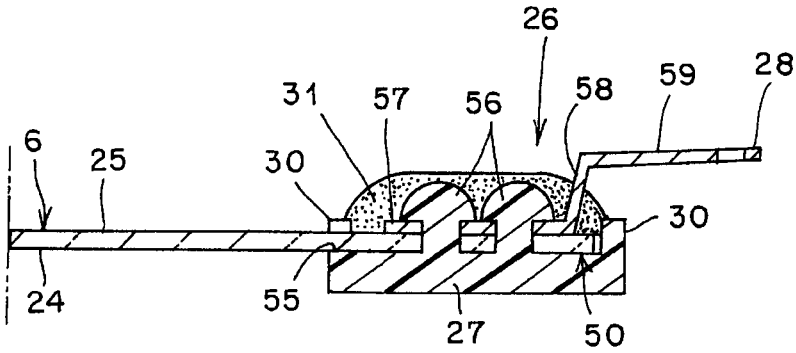
FIG. 18 is a cross-sectional view showing a state in which the power-feeding portion and the male board and the resin board are swaged and fixed and the sealant is provided, similarly.

FIGS. 17 and 18 show a second embodiment of a vehicle lighting device according to the present invention. In the figures, like constituent elements are designated by like reference numerals shown in FIGS. 1 to 16. Hereinafter, the vehicle lighting device according to the second embodiment will be described.

In the vehicle lighting device according to the second embodiment, as shown in FIGS. 17 and 18, a connector 26 is made up of: a male terminal 28 set at a power-feeding electrically conductive paste 49 on one face of a power-feeding film 51 of a power-feeding portion 50; and a resin board 27 having swaged the male terminal 28 and the power-feeding portion 50.

Hereinafter, procedures for assembling the power-feeding portion 50 and the connector 26 will be described. First, a fixing portion 57 of the two male terminals 28 is set at the two power-feeding electrical conductive pastes 49 of the power-feeding portion 50. At this time, a through hole 63 of the power-feeding portion 50 is aligned with a through hole 60 of the male terminal 28. From the side of the power-feeding film 51, a swaging protrusion 56 of the resin board 27 is inserted into the through hole 63 of the power-feeding portion 50 and the through hole 60 of the male terminal 28 (see FIG. 17). At this time, the power-feeding portion 50 and the fixing portion 57 of the two male terminals 28 are placed on one face of the resin board 27 surrounded by ribs 30.

Next, a tip end part of the swaging protrusion 56 of the resin board 27 is crushed. As a result, the power-feeding portion 50 and the two male terminals 28 are swaged between the resin board 27 and the crushed tip end part of the swaging protrusion 56. In this manner, the power-feeding portion 50 and the two male terminals 28 are fixed by swaging the resin board 27 (see FIG. 18). At this time, the power-feeding portion 50; and the male terminal 28 and the resin board 27 are integrally fixed to each other. In addition, the two power-feeding electrically conductive pastes 49 of the power-feeding portion 50 and the fixing portion 57 of the male terminal 28 are electrically connected to each other.

As shown in FIG. 18, on one face of the resin board 27 surrounded by the ribs 30, a sealant 31 made of silicon, for example, is provided so as to cover: a part of the fixing portion 57 and the bridge portion 58 of the two male terminals 28; and the power-feeding film 51 of the power-feeding portion 50; and the power-feeding electrically conductive paste 49; and the crushed tip end part of the swaging protrusion 56. The sealant 31 is adapted to cover and electrically insulate the two power-feeding electrically conductive pastes 49 that are electrically connecting portions and the fixing portion 57 of the two male terminals 28 and to protect from an external shock. In a case where a resist is provided on one face of the power-feeding film 51, such a resist is not provided at a portion at which the fixing portion 57 of the two male terminals 28 is set, among the two power-feeding electrically conductive pastes 49 that are electrically connecting portions. In this manner, the power-feeding film 51 of the power-feeding portion 50 and the two power-feeding electrically conductive pastes 49; and the resin board 27 of the connector 26 and the two male terminals 28 are assembled.

The vehicle lighting device according to the second embodiment is made of the above-described constituent elements, thus making it possible to achieve functions and advantageous effects which are substantially similar to those of the vehicle lighting device according to the first embodiment. In addition, in the vehicle lighting device according to the second embodiment, the connector 26 is formed in such a manner that the male terminal 28 and the power-feeding portion 50 are fixed by swaging the resin board (swaging tool) 27, thus making it possible to improve a swaging fixing strength between the power-feeding portion 50 and the male connector 28 in comparison with a connector formed in such a manner that a male terminal and a power-feeding portion are fixed by swaging a metallic grommeted terminal board (swaging tool). Moreover, the vehicle lighting device according to the second embodiment is formed in such a manner that the male terminal 28 and the power-feeding portion 50 are fixed by swaging the resin board (swaging tool) 27. Thus, the number of parts can be reduced in comparison with a connector formed in such a manner that a resin base, a male terminal, and a power-feeding portion are fixed by swaging a grommeted terminal board (swaging tool), and manufacturing cost can be reduced accordingly.

Hereinafter, examples other than the first and second embodiments will be described. In the first and second embodiments, the wire heater 5 was provided on the interior face of the front part 33 of the lamp lens 4, whereas in the present invention, the wire heater 5 may be provided on an exterior face or both of the interior and exterior faces of the lamp lens 4 in the present invention.

In addition, in the first and second embodiments, the wire heater 5 was provided on the interior face of the front part 33 of the lamp lens 4, whereas in the present invention, at least two heating portions, a high-temperature heating portion and a low-temperature heating portion, may be formed at a wire heater.

Further, the first and second embodiments described an example used in the lamp lens 4 of the head lamps 1L, 1R of the automobile C. Whereas in the present invention, it may be used in a vehicle lighting device other than the headlamps 1L, 1R of the automobile C, for example, signal light such as a stop lamp, illumination light such as a curve lamp, a front combination lamp, or a rear combination lamp.

Furthermore, as a light illuminating portion for illuminating light to the outside through the front part 33 of the lamp lens 4, the first and second embodiments described the projector-type lamp unit 2 employing the semiconductor-type light source 12 as a light source, whereas in the present invention, the light illuminating portion may be a light illuminating portion other than the lamp unit 2. For example, it may be a lamp unit of a projector type, a reflection type, or a direct projection type, of which a light source is a semiconductor-type light source, a power discharge lamp such as HID, a halogen bulb, or an incandescent bulb. Alternatively, in a vehicle lighting device of a projector type, a reflection type, or a direct projection type, it may be a semiconductor-type light source, a light source of a power discharge lamp such as HID, a halogen bulb, or an incandescent bulb, and a combination of the light source and a reflecting surface.

Still furthermore, in the first and second embodiments, the extension portion 6 was provided between the wire heater 5 and the power-feeding portion 50, whereas in the present invention, the extension portion 6 may not be provided between the wire heater 5 and the power-feeding portion 50.

What is claimed is:

1. A vehicle lighting device, comprising:

(i) a lamp housing, which partitions a lamp room, and a lamp lens;

(ii) a light illuminating portion which is disposed in the lamp room and externally illuminates through the lamp lens;

(iii) a wire heater provided by means of transfer at a portion of the lamp lens, through which light from the light illuminating portion of the lamp lens is permeated;

(iv) a power-feeding portion which is integrally provided at the wire heater, for feeding a power current to the wire heater; and (v) a connector which is provided at the power-feeding portion and is electrically connected to a power source-side connector, wherein the wire heater is a transfer-type heater including:

(a) a base film;

(b) an adhesive provided on one face of the base film;

(c) an electrically conductive member for heater, which is formed in a wire pattern on the other face of the base film, a power current being fed, thereby generating a heat; and (d) a resist provided on the other face of the base film so as to cover the electrically conductive member for heater, at least the base film being cut in a pattern that follows the wire pattern of the electrically conductive member heater and which is caused to adhere the adhesive to the lamp lens, thereby transferring the electrically conductive member for heater to the lamp lens, the power-feeding portion including:

(e) a power-feeding film integrally provided on the base film; and (f) a power-feeding electrically conductive member which is formed in a wire pattern on one face of the power-feeding film, one end of which is electrically connected to the electrically conductive member for heater;

the connector including:

(g) a terminal which is set at the power-feeding electrically conductive member on said one face of the power-feeding film;

(h) a first swaging portion for swaging and fixing the terminal and the power-feeding portion to each other in a multilayered state; and (i) a second swaging portion for swaging and fixing the terminal, the power-feeding portion, and the first swaging portion to each other, in a state in which the first swaging portion has swaged and fixed the terminal and the power-feeding portion to each other, wherein:

a hole is formed at a respective one of the terminal and the power-feeding portion;

the first swaging portion has a hollowed protrusion to be inserted into the hole of the respective one of the terminal and the power-feeding portion in the multilayered state, the protrusion being inserted into the hole of the respective one of the terminal and the power-feeding portion, thereby swaging and fixing the terminal and the power-feeding portion to each other in the multilayered state; and the second swaging portion has a swaging protrusion to be inserted into the hollow of the protrusion of the first swaging portion, the swaging protrusion being inserted into the protrusion of the first swaging portion, in a state in which the terminal and the power-feeding portion are swaged and fixed to each other, thereby swaging and fixing the terminal, the power-feeding portion, and the first swaging portion to each other.

2. The vehicle lighting device according to claim 1, wherein:

the second swaging portion is for swaging and fixing the terminal, the power-feeding portion, and the first swaging portion to each other, in a state in which the first swaging portion has swaged the terminal, the power-feeding portion, and a grommeted terminal board to each other.

3. The vehicle lighting device according to claim 1, wherein:

an extension portion of a predetermined length is provided between the wire heater and the power-feeding portion; and the extension portion includes: an extension film integrally provided by a predetermined length between the base film and the power-feeding film; and an extension portion electrically conductive member formed in a wire pattern on one face of the extension film, both ends of which are electrically connected to the electrically conductive member for heater and the power-feeding electrically conductive member, respectively.

* * * * *